US009021976B2

(12) United States Patent
Michaud et al.

(10) Patent No.: US 9,021,976 B2
(45) Date of Patent: May 5, 2015

(54) ON-BOARD RESCUE DEVICE FOR A SHIP

(75) Inventors: Pascal Michaud, Chevanceaux (FR); Sébastien Fourny, St. Martens (FR); Cédric Dronne, Barbezieux (FR)

(73) Assignee: Survitec SAS, Chevanceaux (FR)

( * ) Notice: Subject to any disclaimer, the term of this patent is extended or adjusted under 35 U.S.C. 154(b) by 203 days.

(21) Appl. No.: 13/635,795

(22) PCT Filed: Mar. 16, 2011

(86) PCT No.: PCT/FR2011/050528

§ 371 (c)(1),
(2), (4) Date: Sep. 18, 2012

(87) PCT Pub. No.: WO2011/114054

PCT Pub. Date: Sep. 22, 2011

(65) Prior Publication Data

US 2013/0008367 A1 Jan. 10, 2013

(30) Foreign Application Priority Data

Mar. 19, 2010 (FR) ..... 10 51994

(51) Int. Cl.
*B63B 17/00* (2006.01)
*B63C 9/22* (2006.01)

(52) U.S. Cl.
CPC ..... *B63C 9/22* (2013.01)

(58) Field of Classification Search
CPC ..... B63C 9/22; B63C 9/23; Y10S 244/905; A62B 1/20
USPC ..... 114/365–380; 182/48
See application file for complete search history.

(56) References Cited

U.S. PATENT DOCUMENTS

| | | | | |
|---|---|---|---|---|
| 3,910,532 | A | 10/1975 | Fischer | |
| 7,681,515 | B1 * | 3/2010 | Apple | 114/365 |
| 8,708,101 | B2 * | 4/2014 | Bambrick et al. | 182/48 |
| 2008/0188148 | A1 | 8/2008 | Simon-Bouhet | |

FOREIGN PATENT DOCUMENTS

| | | | | |
|---|---|---|---|---|
| EP | 1 911 674 | A2 | 4/2008 | |
| FR | 2 505 767 | A1 | 11/1982 | |
| FR | 2 912 111 | A1 | 8/2008 | |
| GB | 2079683 | A * | 1/1982 | B63C 9/22 |
| GB | 2 105 264 | A | 3/1983 | |

* cited by examiner

*Primary Examiner* — S. Joseph Morano
*Assistant Examiner* — Andrew Polay
(74) *Attorney, Agent, or Firm* — Patterson Thuente Pedersen, P.A.

(57) ABSTRACT

The rescue device for the passengers and crew of a ship includes: a container that contains survival equipment; a system that is intended for stowing said container relative to the deck of the ship and contains at least one strap and a system for multimodally attaching and releasing said container; an airbag-type inflatable balloon set up between a structure, secured to the deck, and said container, said structure defining a passage for the passengers when needed; and a means for releasing the airbag set up on the wheelhouse of said ship. The frame-shaped structure is formed of: two side posts; a lower cradle, on which said container rests; an upper crosspiece; and a plate set up inside the ship and acting as a counterbearing for the airbag when said container is ejected.

9 Claims, 5 Drawing Sheets

ON-BOARD RESCUE DEVICE FOR A SHIP

PRIORITY CLAIM

The present application is a National Phase entry of PCT Application No. PCT/FR2011/050528, filed Mar. 16, 2011, which claims priority from French Application Number 10 51994, filed Mar. 19, 2010, the disclosures of which are hereby incorporated by reference herein in their entirety.

FIELD OF THE INVENTION

The present invention relates to the field of on-board rescue appliances on ships and more particularly, a rescue device for the passengers and crew, said device, in a preferred embodiment, being formed of a module intended to be installed and fixed on the deck of a ship. The invention also relates to the ship that contains this rescue device.

BACKGROUND OF THE INVENTION

Ships of the ferry type, for transporting a limited number of passengers, of the order of 400 persons for example, contain several rescue appliances, three or four, each of which is formed of a platform having a passenger capacity of the order of 100 to 150 persons. The rescue or survival appliance, as described in particular in document FR 2 505 767, is formed of at least one platform of the inflatable raft type, said raft being associated with an evacuation slide or chute, also inflatable, that when deflated is folded in its entirety into a suitable box that is stowed on the deck of the ship at an evacuation station. The stowage system is generally formed of straps, or other items, which are associated with release systems operated by a crew member. As soon as the appliance has been launched, a firing line interposed between the platform and the ship allows the inflation of the platform as well as the inflation of the access slide to this platform to be initiated. The platform is generally attached to the ship by two lines, or painters, which are manually tensioned during the operation of inflating said platform and the slide, their tension being subsequently adjusted if necessary, still manually. It is increasingly the case that such small ships of the ferry type, providing a quick shuttle service between continents, in fjords or large estuaries, have a small crew, which may even be formed by a captain and a chief engineer only. In the event of distress, the crew is clearly insufficient in number to implement all the survival appliances; each current survival appliance requires the presence of at least one crew member, i.e. a competent person with a minimum amount of training, in order to launch said appliance without incident.

Semi-automatic systems exist in the aviation field as described in document EP 1 911 674 but these are simply slides that can be incorporated directly into the girder below the entrance and exit door of the aircraft. This type of rescue appliance cannot be installed just anywhere; it is formed of a chest that is set into a particular layout and if the chest is installed in a gangway, it permanently obstructs said gangway.

SUMMARY OF THE INVENTION

The present invention proposes a rescue device which, once installed on board ship, makes it possible to dispense with the mandatory presence of crew beside each survival appliance, in order to carry out the deployment of said appliance, as is the case in particular for the type of appliances described in the above-mentioned document FR 2 505 767 and moreover, if necessary, it affords and identifies a gangway.

The rescue device according to the invention, for the passengers and crew of a ship equipped with a wheelhouse, includes:

- a container containing a survival appliance provided with the usual means allowing it to be automatically put into service in the event of distress,
- a system for stowing and lashing said container on the deck of the ship by means of a strap and a conventional multimode system for attaching and releasing the container including, arranged in series, at least one manual release device and a knife-type release system, generally called "ERU" (Electric Release Unit),
- means of expelling said container out of said ship, said means being formed of an inflatable balloon, of the airbag type, said airbag being installed between a structure secured to said deck and said container, and fixed on a support arranged on said support structure, said support being arranged inboard,
- means of firing said airbag, said structure being in the form of a frame surrounding a container in the shape of a parallelepipedic box, this structure being formed: —of two side posts each comprising an element performing the function of a stop and a support for the inboard face of said box, —a lower cradle on which said box is secured and rests, —an upper crosspiece and—a plate installed inboard between said posts, acting as a support and counterbrace for said airbag during the ejection of said box, said support plate being installed on the posts of said frame of the support structure, below the level of the stops by means, on one side, of a vertical pivot pin, and, on the other side, a bolt with a handle, said bolt being capable of deactivation in order to allow said support plate to pivot about its hinge pin, then lock in the folded position, in order to fully clear the opening of said frame through which the evacuation of the passengers takes place in the event of distress.

Still according to the invention, the rescue device includes means allowing each survival appliance to be remotely put into service by a single crew member, from the wheelhouse, said means firing the airbag and including, in particular, an electric cable interposed between an electrical connection box arranged on the support structure and a switch arranged at said wheelhouse.

According to another provision of the invention, the means of stowing and lashing the container relative to the support structure are formed of at least one strap the ends of which are anchored to fixed points arranged in the corners of said support structure, on its lower outside part, said strap passing through a pull ring which is linked, via the multimode attachment and release system, to a rear point of the support structure, said multimode attachment and release system including a serial arrangement of at least one manual release device and a knife-type release system, generally called "ERU" (Electric Release Unit), said knife being linked to the electrical connection box on the support structure and capable of remote operation from a switch installed in the wheelhouse, via the electric cable extending between said switch and said electric box.

Still according to the invention, the means of firing the airbag are formed of the pull ring of the stowage strap, an igniter associated with said airbag and a line interposed between said ring and said igniter, said line, having an appropriate length, is placed in a situation of firing said airbag, automatically, via said pull ring, by means of an elastic pull element, anchored on a fixed point of the support structure, said pull element causing, during the release of the multimode attaching system, in particular by the use of a knife, a sufficient displacement of said pull ring to tauten said line and, via the igniter, to implement said airbag.

According to another provision of the invention, the strap of the stowage system includes a ratchet-type tightener, and one of the sections of said strap comprises the pull element, of the spring or shock cord type, the ends of which are fixed on said length of strap at two points, said points being spaced apart over said length in order to exert tension, preferably of the order of 30 kg, in the direction of the pull ring, and in such a way as to cause a sufficient displacement of said pull ring to tauten the line and fire the airbag, said pull element being tightened using said tightener, at the same time as said strap.

Still according to the invention, the rescue device includes, on each post of the support structure, an electric winch responsible for actuating a painter assisting the deployment and anchoring of the rescue platform, said winches being automatically implemented as soon as the survival appliance is put into service, using a control that includes a timer allowing their implementation to be deferred during the initial deployment and inflation phase of said platform and, optionally, the evacuation chute, said winches also comprising control means making it possible to limit the tension in said painters to an average value of the order of 100 DaN.

According to another provision of the invention, the box-support structure assembly, with the stowage system, is presented in the form of a module capable of being placed on board just as it is for equipping the ship.

Still according to the invention, the support structure is in the form of a cradle supporting at least one container in the form of a cylindrical or parallelepipedic case, the cradle being formed of at least one dihedron with a horizontal part and a vertical part forming a rack to secure said case on the flat deck, said rack comprising points for fixing the stowage strap as well as the multimode attachment and release system and the vertical leg of said rack is arranged with a surface capable of acting as a counterbrace for the airbag when it is put into service.

The invention also relates to the ship equipped with a wheelhouse and at least one rescue device as detailed above and comprising at least one electric cable installed between said rescue device and, at the wheelhouse, at least one switch, said switch making it possible in the event of a distress situation, via action by one of the crew members, to put the different survival appliances into service, i.e. remotely firing, from said wheelhouse, for the purpose of unstowing said appliance, the airbag attached to each rescue device in order to cause the ejection of said survival appliance towards the outside of the ship and its entry into service.

BRIEF DESCRIPTION OF THE DRAWINGS

To enable its execution, the invention is disclosed in a sufficiently clear and comprehensive manner in the following description, which is moreover accompanied by drawings in which.

DETAILED DESCRIPTION OF THE DRAWINGS

Figures 1A, 1B:
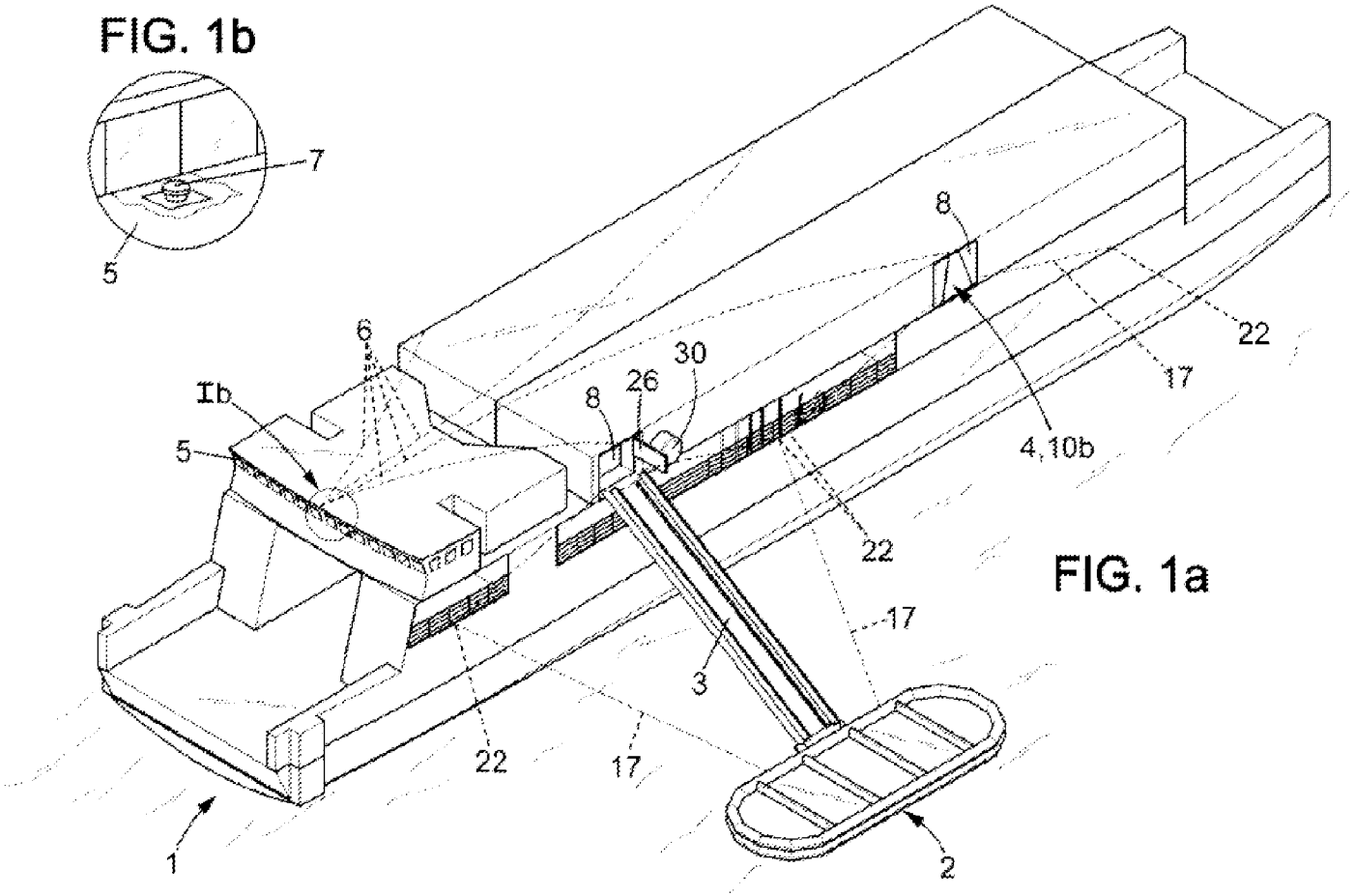
FIG. 1*a* diagrammatically shows a ship of the ferry type, a survival appliance of which is shown deployed ready for use.
FIG. 1*b* shows a detail of the wheelhouse of said ship from FIG. 1*a;*

Increasingly, small ships for the transport of a limited number of passengers, of the ferry type as shown in FIG. 1*a*, have a small crew sometimes limited to a captain and a chief engineer only. This type of ship 1 nevertheless has survival appliances including a platform 2 and a chute 3, as described in the abovementioned document.

The platforms 2 can be formed of one or several inflatable rafts of the type described in document FR 2 912 111, for example. Such a platform 2 can accommodate 100 to 150 passengers; it is linked to the ship 1 by a chute 3 which is also inflatable and, for a ship capable of transporting 400 passengers, the survival appliance can be formed of three or four platforms, distributed in appropriate parts of the ship, on the freeboard or elsewhere.

The rescue device according to the invention, in the form of a module 4, allows the survival appliances to be put into service from the wheelhouse 5 of the ship via a suitable link; this link is, for example, formed of electric cables 6 and can be activated by a single crew member, from the wheelhouse 5 by means of a single switch 7, as shown separately in FIG. 1*b*.

The rescue module 4 is installed in the evacuation openings 8 made in the hull plating at the level of the deck 9.

As shown in the figures, the module 4 includes, generally, a container 10 containing the survival appliance and includes a rigid structure 11, fixed by suitable means on the deck 9 of the ship, said structure 11 supporting and stabilizing the container 10 on said deck 9.

Depending on the type of survival appliance, the support structure 11 can be presented in different ways. It can be in the form of a frame surrounding a container 10 in the shape of a parallelepipedic box 10*b*, as shown in FIGS. 1 to 6, or in the form of a cradle for holding one or more cylindrical, near-cylindrical or parallelepipedic cases 10*c*, as shown in FIG. 7.

The support structure 11, shown specifically in FIGS. 2 to 6, accommodates a box 10*b* containing a survival appliance, i.e. at least one platform 2 and one chute 3 which are stored in a folded deflated state.

The support structure 11 includes in particular side posts 12 and a cradle 13 that extends between said posts 12, in their lower part, on which the box 10*b* is placed and secured. The box 10*b* is lodged in this frame and is kept immobilized, stowed relative to the support structure 11, by means of a holding device, advantageously formed by at least one set of straps 14 and a system, detailed hereinafter in connection with FIG. 4, acting as a system for the multimode attachment of said box 10*b* and its release in the event of distress.

The system of straps 14 allows the box 10*b* to be held firmly against stops 15 arranged inboard on the side posts 12. These stops 15 act as a support for securing the box 10*b* and are situated on the upper part of the posts 12 in order to be in contact with the upper part of said box 10*b*.

Figure 2:
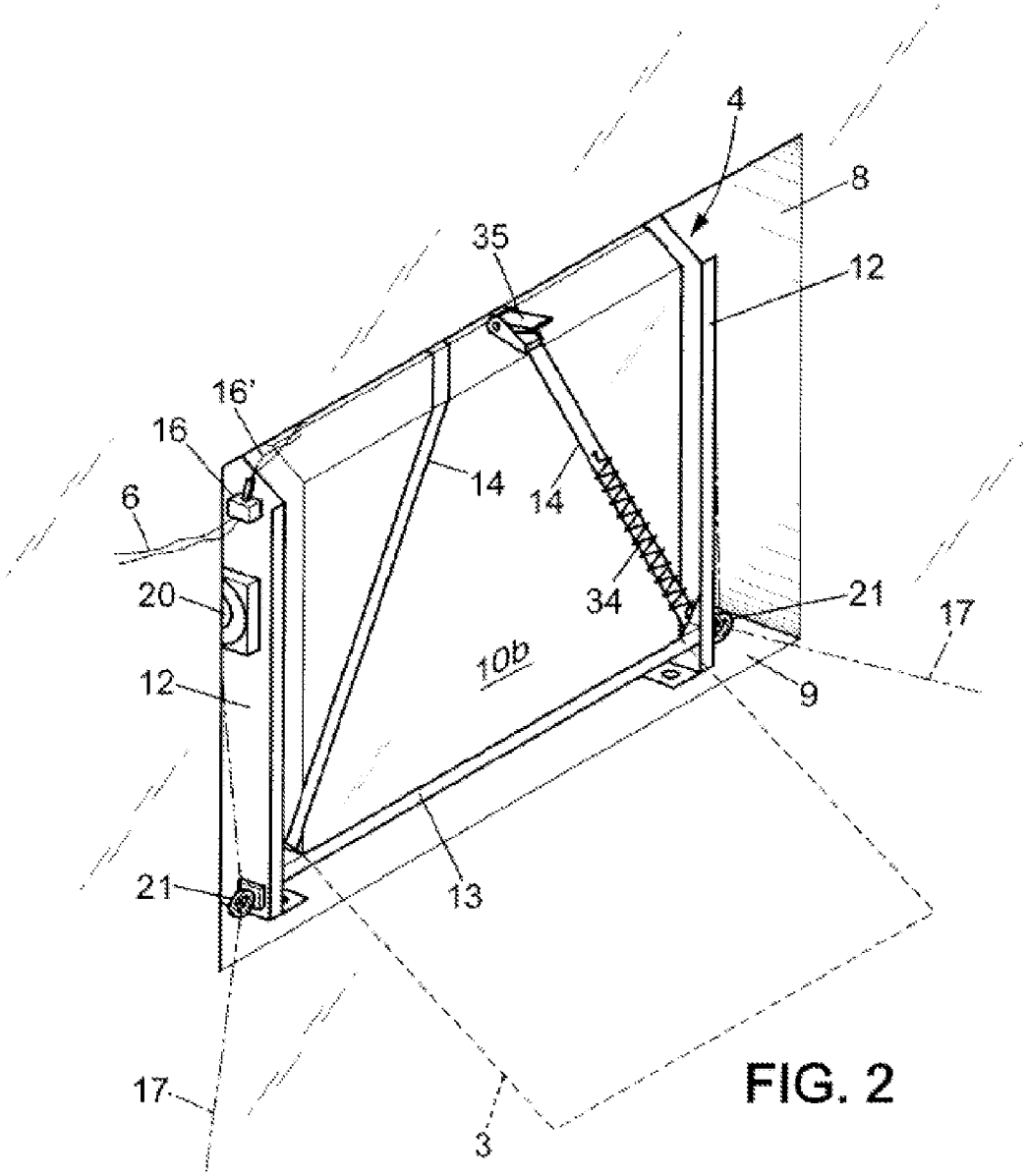
FIG. 2 shows the rescue device, presented in the form of a module installed on the hull plating of a ship at an evacuation station, in which the box containing the survival appliance can be seen.

The release of the straps 14 is controlled from the wheelhouse 5 by the switch 7 and by the electric cables 6 which reach the module 4 and, in particular, on an electrical connection box 16 that is shown in FIG. 2 in particular, said box being fixed on one of the posts 12 of the support structure 11.

Still in FIG. 2, the chute 3 shown in thin chain-dotted lines will be noted, extending from the cradle 13, linked to the latter via at least one painter, not shown, associated with a conventional hydrostatic system for automatic release in the case of shipwreck, in particular.

Still in FIG. 2, the painters 17 are also noted, making it possible to hold and stabilize the platform 2 relative to the ship 1, in particular during the phase of inflation of the platform 2 and while passengers board the latter.

The painters 17 are automatically implemented during the deployment of the platform 2 and the chute 3, using electric winches 20 that are laterally arranged on the outside of the side posts 12 of the support structure 11.

The painters 17, also shown in FIG. 1, also pass through conventional release systems of the hydrostatic type, not shown, which operate automatically in the event of shipwreck in particular. Using sheaves or otherwise, the painters 17 run between the winches 20 and the fore and aft ends of the platform 2. Sheaves 21 are arranged on the lower part of the frame of the support structure 11 and sheaves 22 are arranged on the hull plating of the ship, on each side of each opening 8, in order to hold the painters 17 away from each side of the chute 3. These sheaves 22 are in fact spaced apart by a distance greater than the length of the platform 2, so as to best stabilize the platform 2 during its deployment phase and, if possible, throughout its entire loading time.

The winches 20 form part of the rescue module 4 and are implemented automatically as soon as the platform 2 and its chute 3 are launched, controlled by an integrated timer, said timer making it possible to defer the tightening of the painters 17 for sufficient time for almost complete deployment of the platform 2 and the chute 3 to be carried out.

The winches 20 also comprise integrated means allowing the monitoring and control of the tension in the painters 17, so as to limit the tension to a value of the order of 100 DaN for example.

Figure 3:
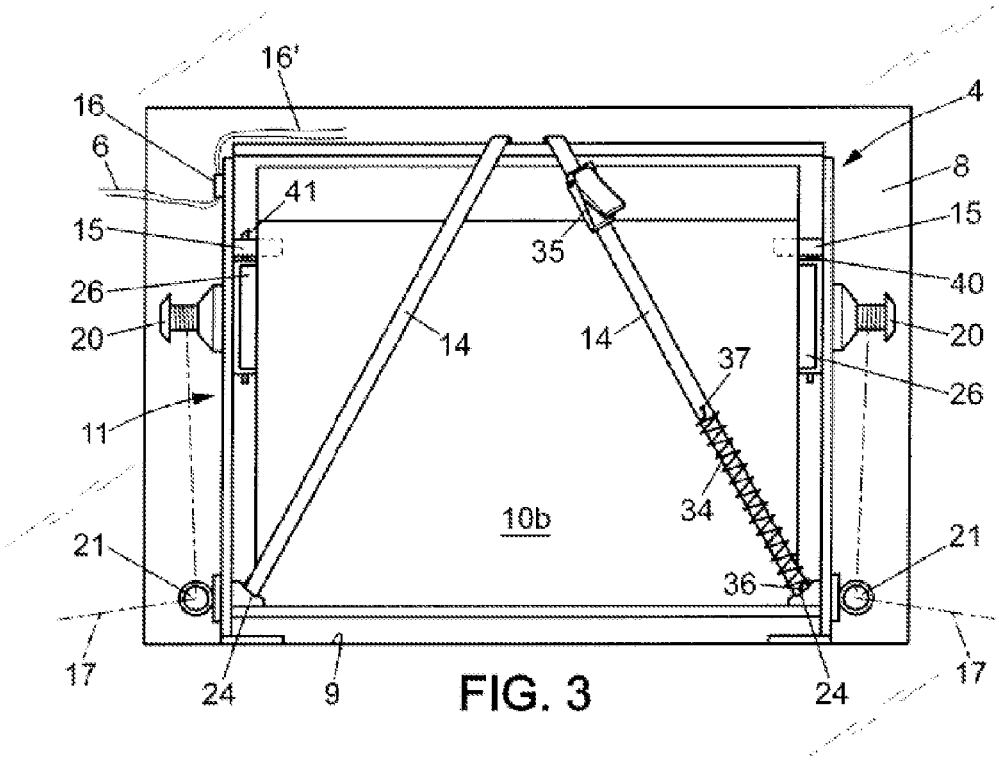
FIG. 3 is a front view of the survival appliance installed on the ship, seen from the outside of said ship.

FIG. 3 shows the winches 20 installed laterally on the support structure 11 as well as the guide elements of the painters 17 of the sheave 21 type or simply rings.

Still in FIG. 3, the electrical connection box 16 will be noted, through which the pulse arrives for initiating the launch operation of the box 10*b* that contains and encloses the survival appliance, i.e. the platform 2 and the chute 3.

The box 10*b* is placed and secured on the cradle 13 that forms the lower part of the frame of the support structure 11, said frame including, on the upper part of the side posts 12, an upper crosspiece 23 in the form of a grab rail that allows the passengers, during the evacuation operation, to steady themselves at the entrance, at the upper end of the chute 3, before entering said chute.

The box 10*b* is held in the structure support 11, resting against the stop elements 15, by the straps 14 that form a sort of inverted V on the outer face of the box 10*b*. The V extends between anchorage points 24 arranged in the corners of the frame of the support structure 11, in the lower external part of the frame, and a ring 25 shown in FIG. 4.

The ring 25 is linked to the support structure 11 by a suitable attachment system passing above the upper crosspiece 23. Ring 25 is linked, in particular, to a plate 26 extending between the posts 12 of said support structure 11, on the upper part of said posts 12, inboard, below the level of the stops 15.

Between the ring 25 on the strap 14 and the bracket 27 on the support plate 26 is a multimode attachment and release system. This attachment system extends from the ring 25 to the bracket 27 and in fact includes several attachment and release systems arranged in series and, in particular, a manual release system 28 and a knife 29 known by the name ERU (Electric Release Unit) from the company Hammar, based in Frölunda in Sweden. This knife 29 can be operated either conventionally by a hydrostatic mechanism, or by an electromechanical mechanism.

The electromagnetic knife 29 is linked to the electrical connection box 16 by wires 16 and can be activated directly from the wheelhouse 5 if necessary, by means of the switch 7 and electric cables 6 or others.

Figure 4:
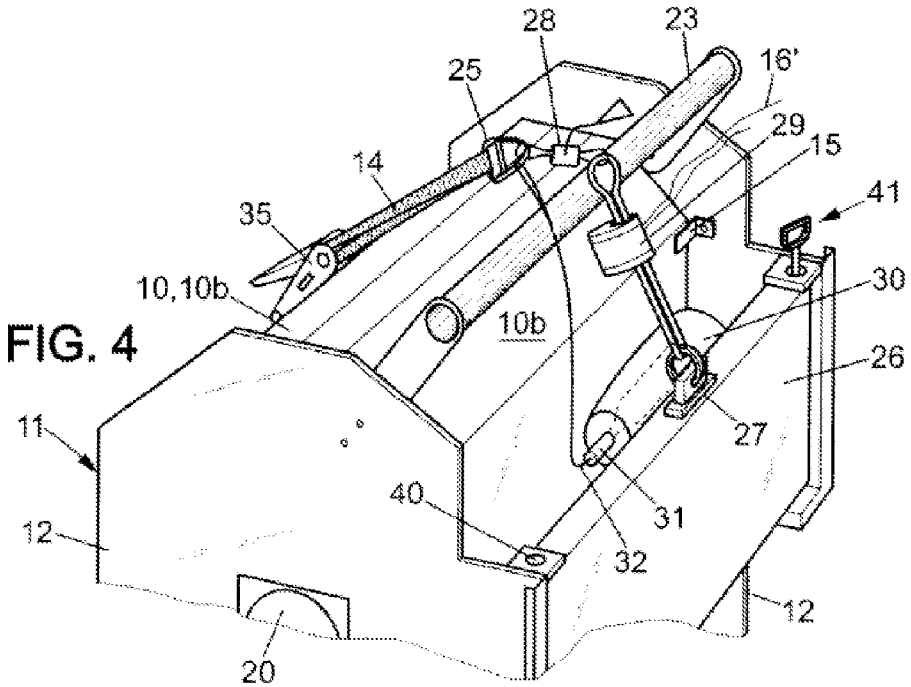
FIG. 4 is a partial top view in perspective, showing the strapping system and the multimode attachment and release system of the survival appliance that are installed on the box support structure.

Still in FIG. 4, between the box 10*b* and the support plate 26, a balloon of the airbag type 30, the igniter 31 of which is linked, by means of a line 32, to the ring 25 which is arranged at the end of the V formed by the strap 14. The plate 26 acts as a counterbrace for the airbag 30 when it is put into service in order to eject the box 10*b*.

The line 32 is arranged parallel to the multimode attachment and release system of the box 10*b*; it is tightened and actuated automatically, as soon as the ring 25 has been released, by means of an elastic pull element 34 which acts as a return element for pulling on said line 32, with a force which is preferably at least of the order of thirty kg, in order to implement the igniter 31 that causes the inflation of the airbag 30.

The strap 14 comprises two sections separated by a ratchet-type tightener 35, one of the sections comprising, installed lengthwise between two points 36 and 37, the pull element 34. The pull element 34 is tensioned by means of the tightener 35, at the same time as said strap 14, with a tension of the order of thirty kg at least and this tension makes it possible, during the releasing of the ring 25, to pull on said ring 25 which, via the line 32, actuates the igniter 31 of the airbag 30. The distance between the two fixing points 36 and 37 of the pull element 34 is chosen as a function of the retraction capacity of said pull element 34, in order to allow it to pull on the line 32, with sufficient travel, in order to cause the actuation of the igniter 31 and put the airbag 30 into service.

The pull element 34 is, preferably, formed by a cylindrical helical spring made from a corrosion-resistant material; it can of course also be formed by a shock cord.

Figure 5:
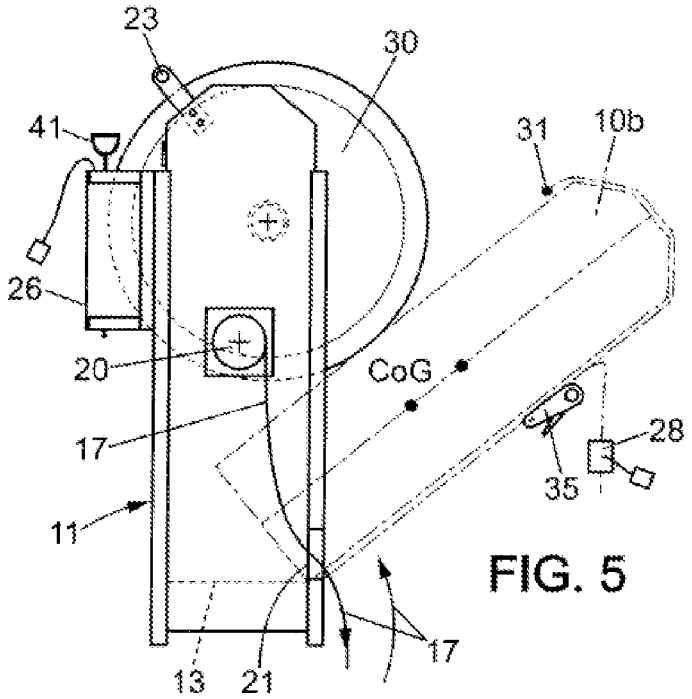
FIG. 5 shows a side view of the survival appliance in the process of ejection from the frame of the support structure by means of the airbag.

The means of implementation of the airbag 30 therefore include: the ring 25, the igniter 31 and the line 32, which forms the link between the two. The firing of the airbag 30 is carried out from the wheelhouse 5, said airbag 30 causing, as shown in FIG. 5, a tipping of the box 10*b* containing the survival appliance, and its ejection out of the ship. The survival appliance is however tied to the support structure 11 and is implemented automatically, as detailed in the above-mentioned documents.

Figure 6:
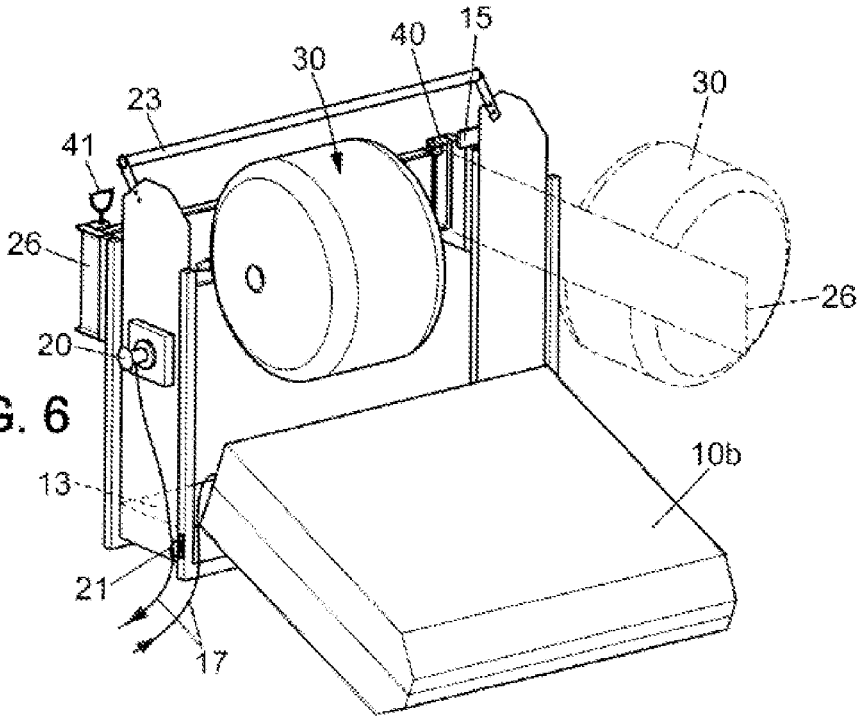
FIG. 6 is a perspective view from outside the ship, showing the ejected survival appliance before deployment and, in thin chain-dotted lines, the position adopted by the support plate bearing the airbag, in order to clear the opening of the support structure frame, said opening acting as a passageway for the evacuation of the ship's passengers in the event of distress.
Figure 7:
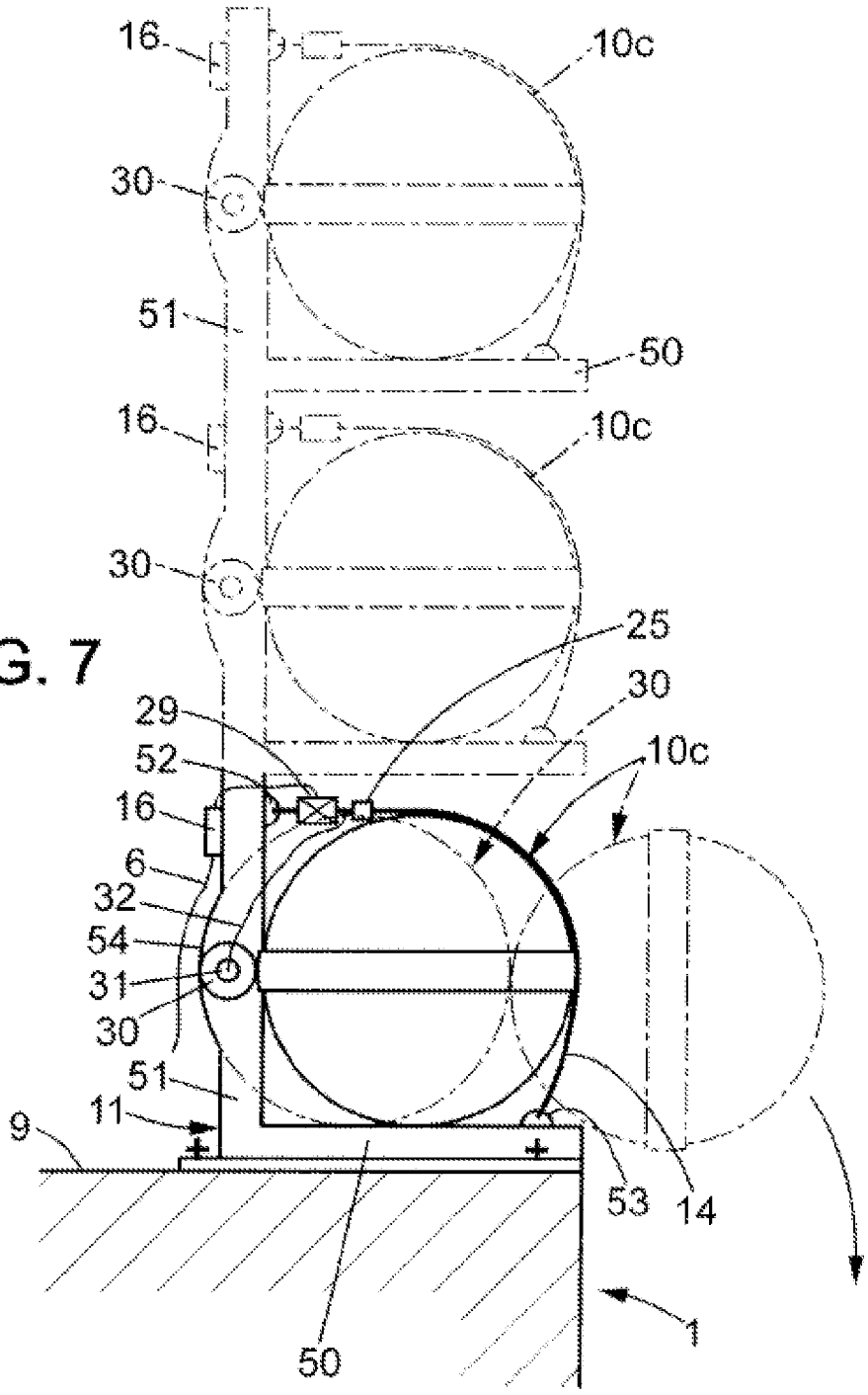
FIG. 7 shows a side view of a variant of the rescue device, installed on the flat deck of a ship.

In FIG. 6, the box 10*b* is ejected from the support structure 11, ready to drop into the water and open, to allow the automatic deployment of the platform 2 and the chute 3. The ejection of the box 10*b* also makes it possible to clear the passage in the frame formed by the support structure 11. The cradle 13 of this support structure 11 forms a sort of step for accessing the chute 3 during evacuation.

In order to facilitate passenger access and passage, the support plate 26 is hinged relative to the frame of the support structure 11. On one side, the support plate 26 is hinged on the post 25 about a substantially vertical pivot pin 40 and, at its other end, said plate 26 is immobilized on the other post 12 by means of a rod with a handle, acting as a bolt 41; the bolt 41, interposed between the corresponding post 12 and said plate 26, can be deactivated easily by means of said handle, by a passenger or otherwise, in order to release the support plate 26.

The support plate 26 can then pivot about its pivot pin 40, as shown in FIG. 6 in particular, towards the outside of the ship, bearing the airbag 30 which is also positioned outside the frame in order to fully clear the passage in the frame of the support structure 11, said frame, as previously stated, defining the opening that allows the evacuation of the passengers to the survival appliance.

Additional means, not shown, associated with the post 12, lock the support plate 26 in the folded position.

FIG. 7 shows another embodiment of the rescue device according to the invention, and in particular a rescue device formed of one or more containers only containing one or more rafts, with no chute, said rafts being intended to be thrown overboard into the water.

The rescue device includes a support structure 11 in the form of a cradle that can accommodate one or more containers 10 in the form of cylindrical, near-cylindrical or parallelepipedic cases 10*c*.

The support structure is fixed on the edge of the flat deck 9 and is composed of one or more dihedrons in the form of a rack, according to the storage requirements of the survival appliance.

The dimensions of the base dihedron correspond to the space requirement of the case 10*c*. Its lower leg 50 is fixed to the flat deck 9: its length corresponding substantially to the diameter of the case 10*c* and its vertical leg 51 is substantially longer. The two branches 50 and 51 comprise respectively, feet 53 and 54 for fixing the means of lashing the case 10*c*; these lashing means, as shown in detail in FIG. 4, are formed of the strap 14 of the multimode attachment and release system which is in particular formed of the knife 29, said knife 29 being electrically connected to the electrical connection box 16 that is shown on the back of the vertical leg 51 of the cradle. The electrical connection box 16 is linked, as detailed previously, to the switch 7 that is situated in the wheelhouse 5.

The vertical leg 51 of the cradle is also provided with a support surface 54 to accommodate an airbag 30 of the same type as that used for ejecting the box 10*b*.

The airbag is put into service in the same way as previously, i.e. by means of a line 32 linked to the ring 25.

The airbag 30 is also shown in thin chain-dotted lines; after said airbag 30 has been put into service, the case 10*c* is ejected overboard. It is held by a suitable painter and by means of a conventional automatic release system of the hydrostatic type.

Several cases 10*c* can be superimposed and each is lashed in the same way with the same attachment and release system as detailed above. The release is carried out from the wheelhouse 5, with, however, an ejection sequence making it possible to stagger the putting into service of the different survival appliances over time.

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. A rescue device for the passengers and crew of a ship equipped with a wheelhouse and including:

a container containing at least one survival appliance said survival appliance to be put into service automatically in the event of distress, a stowage and lashing system for stowage and lashing of said container relative to a deck of the ship and an attachment and release system for said container, an airbag having an inflatable balloon for expelling said container from the ship, said airbag being installed between a structure to be secured to the deck and said container, and said airbag being fixed on a support arranged on said structure, said support being arranged inboard, firing means for firing said airbag, wherein said structure is in the form of a frame surrounding said container in the shape of a parallelepipedic box and said structure includes:

two side posts, each comprising a stop element acting as a stop and a support for a face of said box that is inboard, a lower cradle on which said box is secured and rests, an upper crosspiece and a plate support installed inboard between said posts, acting as support and counterbrace for said airbag during ejection of said box, said plate support being installed on said posts of said frame of said structure, below the level of said stop elements by means, on one side, of a vertical pivot pin, and, on the other side, a bolt with a handle, said bolt being capable of deactivation in order to allow said plate support to pivot about said pivot pin, then lock in folded position.

2. The device according to claim 1, each survival appliance to be put into service by a single crew member, from the wheelhouse, including said firing means for firing said airbag and including an electric cable interposed between an electrical connection box arranged on said structure and a switch arranged at said wheelhouse.

3. The device according to claim 1, wherein said stowage and lashing system is formed of at least one strap having ends which are anchored on fixed points arranged in corners of said structure, in a lower external part of said structure, said strap passing through a ring that is linked, using a multimode attachment and release system, to a point situated inboard aft of said structure, said multimode attachment and release system including, arranged in series, at least one manual release device and an Electric Release Unit, said Electronic Release Unit being linked to said electrical connection box of said structure and capable of remote operation from said switch installed in the wheelhouse, via said electric cable extending between said switch and said electrical connection box.

4. The device according to claim 3, wherein said airbag firing means are formed of said ring of said lashing strap, an igniter associated with said airbag and a line interposed between said ring and said igniter, said line being placed in the situation of firing said airbag automatically, via said ring, by means of an elastic pull element anchored to a fixed point of said structure, said pull element causing, during the release of the multimode attachment and release system by use of said Electronic Release System, a sufficient displacement of said ring to tauten said line and, using said igniter, to implement said airbag.

5. The device according to claim 4, wherein said strap of said stowage and lashing system includes a ratchet-type tightener, wherein one of sections of said strap comprises said elastic pull element , of the spring or shock cord type, ends of which are fixed on said section of strap at two points, said points being spaced apart on said section of strap so as to exert tension in the direction of said ring , and in order to cause sufficient displacement of said ring to tauten said line and fire said airbag, said elastic pull element being tensioned using said tightener, at the same time as said strap.

6. The device according to claim 5, wherein an assembly including said box and said structure, with said stowage and lashing system, is in the form of a module.

7. The device according to claim 1, including, on each post of said structure, an electric winch responsible for actuating a painter to assist with deployment and anchoring of a rescue platform of at least one survival appliance, said winches being implemented automatically, as soon as said survival appliance is put into service, by means of a winch which controller that includes a timer allowing for an implementation of said winches and inflation of said rescue platform and, an evacuation chute, said winch controller also controlling the tension in said painters to an average value of about 100 daN.

8. A rescue device for the passengers and crew of a ship equipped with a wheelhouse and including:

a container containing at least one survival appliance provided with servicing means allowing said survival appliance to be put into service automatically in the event of distress, a stowage and lashing system for stowage and lashing of said container relative to a deck of the ship and an attachment and release system for said container, expelling means for expelling said container out of the ship, said expelling means comprising an airbag having an inflatable balloon, said airbag being installed between a structure to be secured to the deck and said container, and said airbag being fixed on a support arranged on said structure, said support being arranged inboard, firing means for firing said airbag, wherein said structure is in the form of a cradle supporting at least one container in the form of a cylindrical or parallelepipedic case, said structure being formed of at least one dihedron with a horizontal leg and a vertical leg forming a rack to secure said case on the flat deck of the ship, said rack comprising feet for fixing said strap as well as said attachment and release system and said vertical leg of said rack being arranged with a support surface capable of acting as a counterbrace for said airbag when put into service.

9. A ship equipped with a wheelhouse and at least one rescue device including a container containing at least one survival appliance allowing said survival appliance to be put into service automatically in the event of distress, a stowage and lashing system for stowage and lashing of said container relative to the deck of the ship and an attachment and release system for said container, expelling means for expelling said container out of the ship, said expelling means comprising an airbag having an inflatable balloon, said airbag being installed between a structure to be secured to the deck and said container, and said airbag being fixed on a support arranged on said structure, said support being arranged inboard, firing means for firing said airbag, wherein said structure is in the form of a frame surrounding said container in the shape of a parallelepipedic box and said structure is formed:

of two side posts, each comprising a stop element acting as a stop and a support for a face of said box that is inboard, a lower cradle on which said box is secured and rests, an upper crosspiece and a plate support installed inboard between said posts, acting as support and counterbrace for said airbag during ejection of said box, said plate support being installed on said posts of said frame of said structure, below the level of said stop elements by means, on one side, of a vertical pivot pin, and, on the other side, a bolt with a handle, said bolt being capable of deactivation in order to allow said plate support to pivot about said pivot pin, then lock in folded position, and comprising at least one electric cable installed between said rescue device and at least one switch arranged in said wheelhouse, making it possible to put at least one survival appliance into service from the wheelhouse, in the event of a distress situation, through action by one of the crew members.

* * * * *